US010442190B2

(12) United States Patent
Shikata

(10) Patent No.: US 10,442,190 B2
(45) Date of Patent: Oct. 15, 2019

(54) PRINTING METHOD AND PRINTING DEVICE

(71) Applicant: SEIKO EPSON CORPORATION, Tokyo (JP)

(72) Inventor: Ritsuo Shikata, Matsumoto (JP)

(73) Assignee: SEIKO EPSON CORPORATION, Tokyo (JP)

( * ) Notice: Subject to any disclaimer, the term of this patent is extended or adjusted under 35 U.S.C. 154(b) by 78 days.

(21) Appl. No.: 15/467,741

(22) Filed: Mar. 23, 2017

(65) Prior Publication Data

US 2017/0282548 A1 Oct. 5, 2017

(30) Foreign Application Priority Data

Apr. 4, 2016 (JP) ..... 2016-074976

(51) Int. Cl.
*B41J 2/045* (2006.01)
*B41J 2/21* (2006.01)

(52) U.S. Cl.
CPC ..... *B41J 2/04551* (2013.01); *B41J 2/04586* (2013.01); *B41J 2/2103* (2013.01); *B41J 2/2114* (2013.01); *B41J 2/2117* (2013.01)

(58) Field of Classification Search
CPC .... B41J 2/04551; B41J 2/2103; B41J 2/2117; B41J 2/2114; B41J 2/04586
See application file for complete search history.

(56) References Cited

U.S. PATENT DOCUMENTS

2006/0158473 A1 7/2006 Mills et al.
2009/0244605 A1* 10/2009 Yoshida ..... B41J 11/0015 358/1.15
2011/0018917 A1 1/2011 Fujisawa et al.
2012/0019579 A1 1/2012 Usuda et al.
2013/0106943 A1 5/2013 Kagata
2014/0210887 A1 7/2014 Fernandez Del Rio et al.

FOREIGN PATENT DOCUMENTS

JP 2012-061781 A 3/2012

OTHER PUBLICATIONS

Extended European Search Report dated Sep. 13, 2017 in related European Appl. No. 17163479.3 (9 pgs.).

* cited by examiner

*Primary Examiner* — Justin Seo
(74) *Attorney, Agent, or Firm* — Foley & Lardner LLP

(57) ABSTRACT

A printing method of printing a background and an image on a medium includes a background printing step of printing a background on the medium by discharging background ink, and an image printing step of being performed in parallel with the background printing step and printing an image on the medium by discharging image ink. A non-printing area, where the background ink and the image ink are not discharged to a boundary between the background and the image, is provided in the background printing step and the image printing step.

2 Claims, 6 Drawing Sheets

PRINTING METHOD AND PRINTING DEVICE

BACKGROUND

1. Technical Field

The present invention relates to a printing method and a printing device for an ink jet printer and the like.

2. Related Art

As an example of a printing device, an ink jet type printing device has been known that performs printing by discharging ink to a medium such as a paper sheet. Among such printing devices, there is a printing device that performs printing by superimposing an image formed by image ink such as color ink on a background which is printed with background color ink such as white ink (for example, JP-A-2012-61781).

The printing device as described above has a pause time for waiting for drying the background from when the background is printed by discharging the background color ink to when the printing of the image is started by discharging the image ink in order to suppress generation of blur between the background and the image which are printed on a medium. In this way, a color mixture between the background color ink and the image ink that are discharged to the medium is suppressed, so that the generation of blur is suppressed.

However, the printing device as described above has a pause time for waiting for drying the background from when the background is printed by discharging the background color ink (background ink) to when the printing of the image is started by discharging the image ink, so that a time required to print the background and the image increases and there is a risk that printing speed decreases.

SUMMARY

An advantage of some aspects of the invention is to provide a printing method and a printing device that can suppress decrease of printing speed of the background and the image while suppressing the generation of blur in the background and the image when printing the background using the background ink and the image using the image ink.

Hereinafter, means for solving the above problem and functional effects thereof will be described. A printing method for solving the above problem is a printing method of printing a background and an image on a medium. The printing method includes a background printing step of printing a background on the medium by discharging background ink and an image printing step of being performed in parallel with the background printing step and printing an image on the medium by discharging image ink. A non-printing area, where the background ink and the image ink are not discharged to a boundary between the background and the image, is provided in the background printing step and the image printing step.

According to the above configuration, the background printing step of printing the background and the image printing step of printing the image are performed in parallel, so that the background and the image can be printed at the same time. Therefore, it is possible to shorten a time required to print the background and the image. Further, in the in the background printing step and the image printing step, a non-printing area, where the background ink and the image ink are not discharged to a boundary between the background and the image, is provided. Therefore, it is possible to suppress that the background ink and the image ink are mixed at the boundary between the background and the image and blur occurs between the background and the image.

In this way, according to the above configuration, it is possible to suppress decrease of printing speed of the background and the image while suppressing the generation of blur in the background and the image when printing the background using the background ink and the image using the image ink adjacent to each other.

It is preferable that the printing method further includes a base printing step of printing a base by discharging base ink to the medium before the background printing step and the image printing step and overprints the background and the image on the base.

According to the above configuration, it is possible to print the background and the image on the base, so that it is possible to obtain good color development of the background and the image regardless of ground color of the medium. It is preferable that the background ink and the base ink are ink of the same color in the above printing method.

When the background and the image are overprinted on the base, if the non-printing area is provided, there is a case in which the base is exposed to the boundary between the background and the image and thereby the print quality is deteriorated. In this respect, according to the above configuration, the background ink and the base ink are ink of the same color, so that even when the base is exposed to the boundary between the background and the image, the exposed base is seen as integrated with the background. Therefore, it is possible to suppress deterioration of print quality.

A printing device that solves the above problem prints a background and an image on a medium. The printing device includes a first nozzle that discharges background ink to the medium to print the background, a second nozzle that discharges image ink to the medium to print the image, a moving unit that performs a relative movement operation that relatively moves the medium and the first and the second nozzles, and a control unit that causes the first nozzle to discharge the background ink to print the background and causes the second nozzle to discharge the image ink to print the image during the relative movement operation. The control unit provides a non-printing area, where the background ink and the image ink are not discharged to a boundary between the background and the image, when causing the boundary between the background and the image to be printed during one relative movement operation.

According to the above configuration, in the printing device, it is possible to obtain the functional effects achieved by the printing method described above.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, an embodiment of a printing method and a printing device will be described with reference to the drawings. The printing device of the embodiment is an ink jet printer that prints characters and images by discharging ink to a medium M such as cloth.

Figure 1:
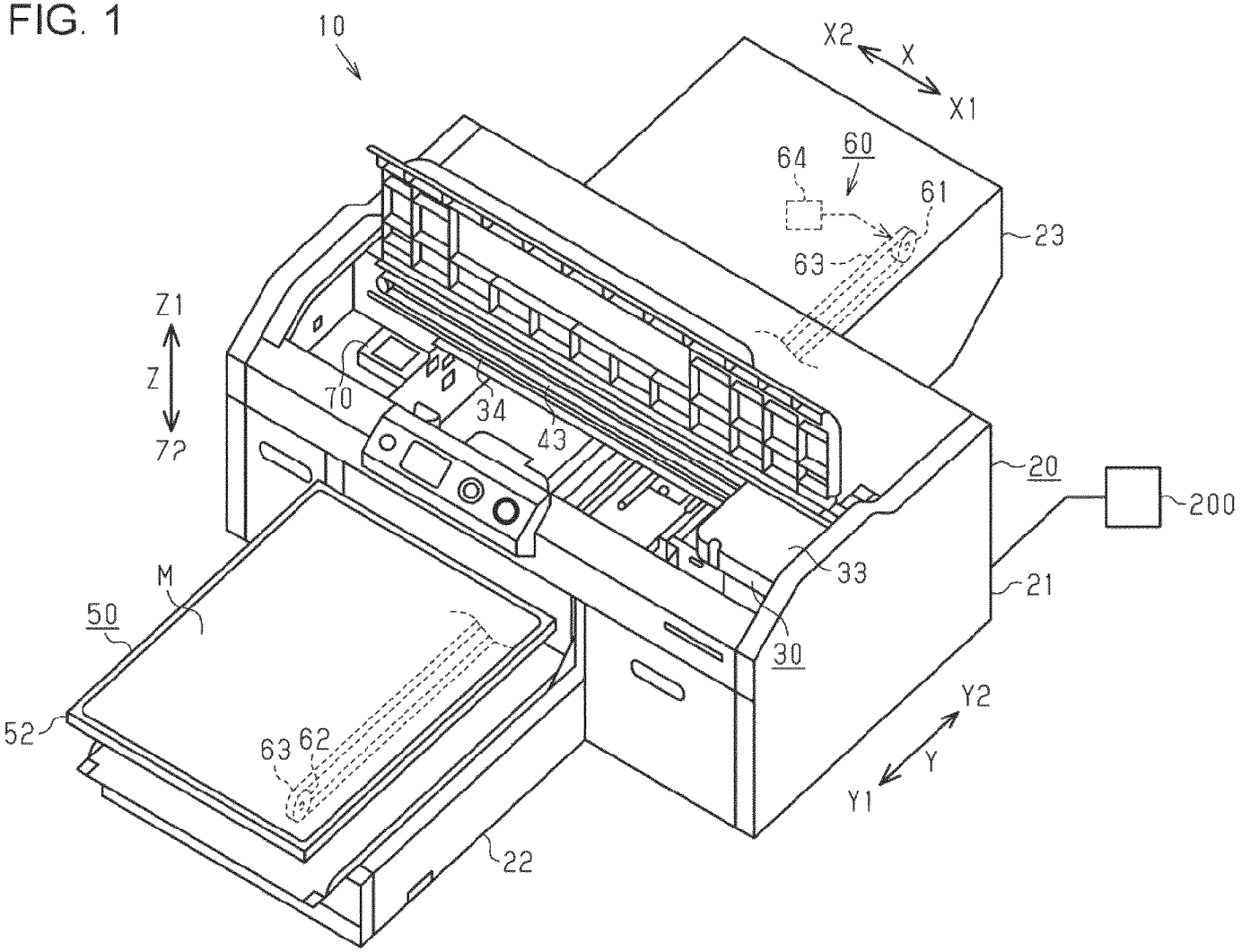
FIG. 1 is a perspective view of a printing device of an embodiment.
Figure 2:
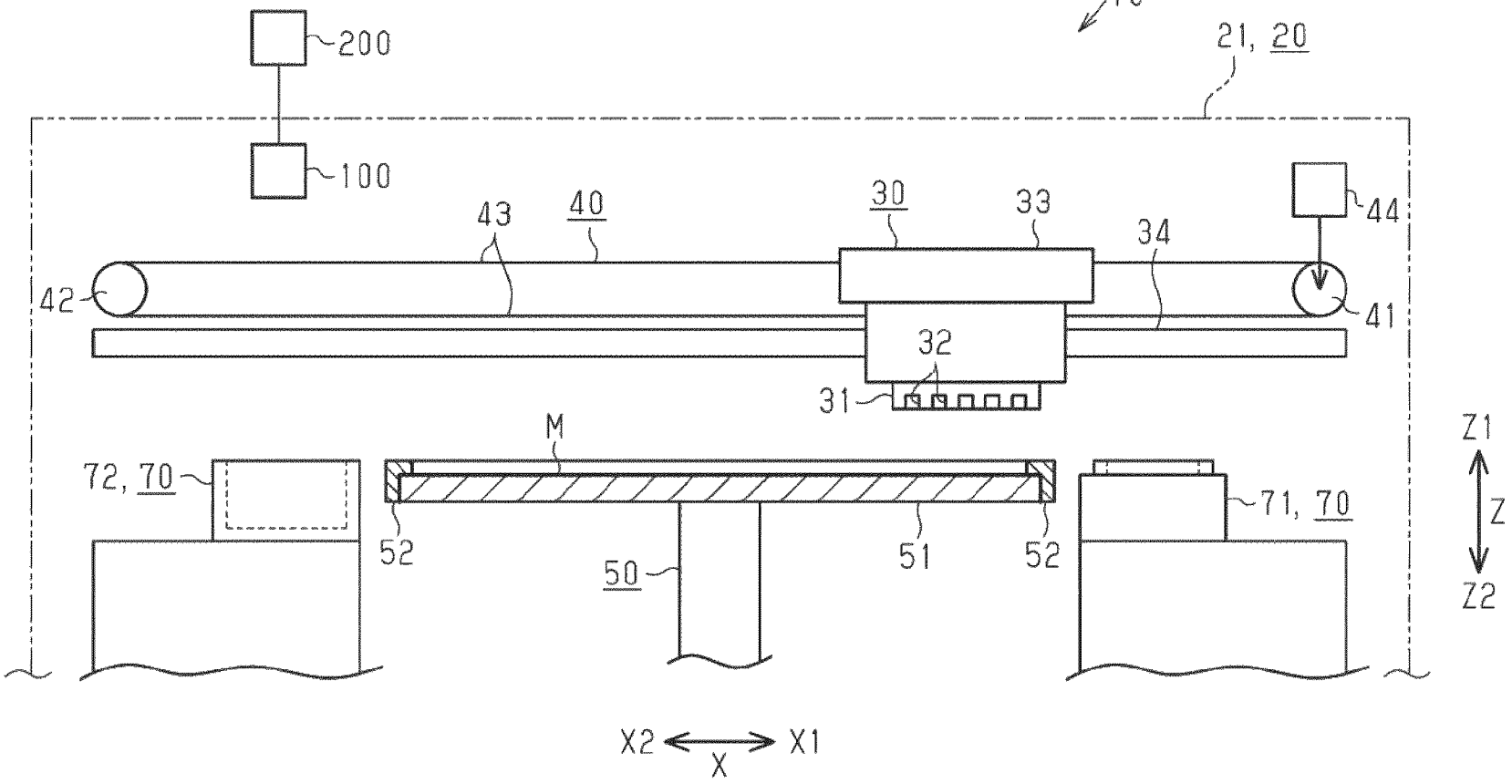
FIG. 2 is a front view showing an internal structure of the printing device.

As shown in FIGS. 1 and 2, a printing device 10 includes a box-shaped housing 20, a printing unit 30 that performs printing on the medium M, a moving unit 40 (see FIG. 2) that moves the printing unit 30, a support unit 50 that supports the medium M, a transport unit 60 that transports the support unit 50 (the medium M), and a maintenance unit 70 that performs maintenance on the printing unit 30.

In the description below, a width direction of the printing device 10 is defined as a "scanning direction X (X1, X2)", a front/rear direction of the printing device 10 is defined as a "transport direction Y (Y1, Y2)", and a vertical direction of the printing device 10 is defined as a "perpendicular direction Z (Z1, Z2)". Here, the scanning direction X, the transport direction Y, and the perpendicular direction Z are orthogonal to each other.

As shown in FIG. 1, the housing 20 has a first housing 21 that forms a main body portion, a second housing 22 that is provided to protrude frontward from the first housing 21, and a third housing 23 that is provided to protrude rearward from the first housing 21. The first housing 21 has a gate shape to be able to house main components of the printing device 10, such as the printing unit 30, and allow the support unit 50 to move in the transport direction Y. The second housing 22 can support the support unit 50 from vertically beneath and the third housing 23 can house the support unit 50.

As shown in FIG. 2, the printing unit 30 includes a discharge head 31 having nozzles 32 that discharge ink, a carriage 33 that supports the discharge head 31, and a guide shaft 34 that reciprocatively movably supports the carriage 33 in the scanning direction X.

Figure 3:
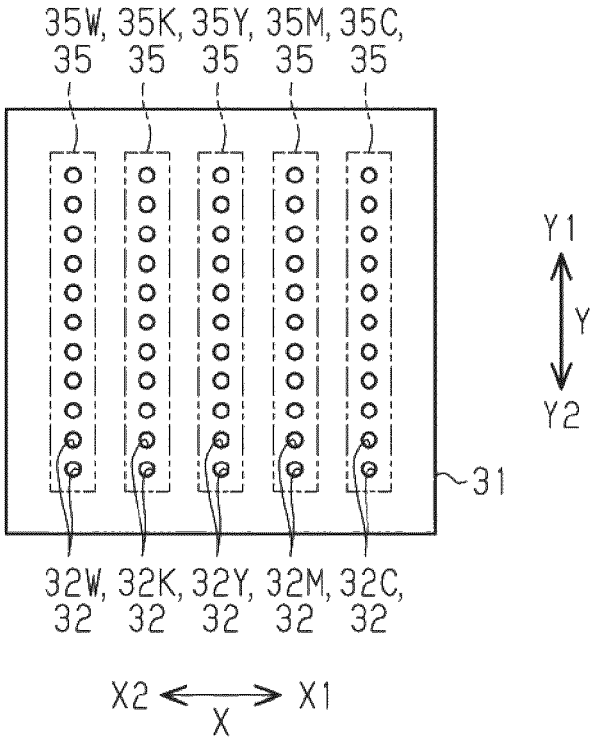
FIG. 3 is a bottom view of a discharge head of the printing device.

As shown in FIG. 3, the discharge head 31 has a plurality of (in the embodiment, five) nozzle arrays 35 including a plurality of nozzles 32 that discharge different types of inks. Specifically, the discharge head 31 has a nozzle array 35C including a plurality of nozzles 32C that discharge cyan ink, a nozzle array 35M including a plurality of nozzles 32M that discharge magenta ink, a nozzle array 35Y including a plurality of nozzles 32Y that discharge yellow ink, and a nozzle array 35K including a plurality of nozzles 32K that discharge black ink. The discharge head 31 also has a nozzle array 35W including a plurality of nozzles 32W that discharge white ink. The discharge head 31 is supported by the carriage 33 so that a formation direction of the nozzle arrays 35 crosses (for example, orthogonally crosses) the scanning direction.

As shown in FIG. 2, the moving unit 40 includes a drive pulley 41 that is provided at one end side (X1 side) in the scanning direction X, a driven pulley 42 that is provided at the other end side (X2 side) in the scanning direction X, a timing belt 43 that is wrapped around the drive pulley 41 and the driven pulley 42, and a carriage motor 44 that drives the drive pulley 41.

Regarding the printing unit 30 and the moving unit 40, the carriage motor 44 rotates, so that the drive pulley 41 rotates. When the drive pulley 41 rotates, the timing belt 43 that is wrapped around the drive pulley 41 and the driven pulley 42 rotates. Subsequently, the carriage 33 coupled to the timing belt 43 moves in the scanning direction X that is the longer direction of the guide shaft 34. In this respect, the moving unit 40 of the embodiment performs a "relative movement operation" in which the moving unit 40 relatively moves the medium M supported by the support unit 50 and the carriage 33 that supports the discharge head 31, in which the nozzles 32 are formed, in the scanning direction X.

The carriage 33 moves in the scanning direction X1 or in the scanning direction X2 according to a rotation direction of the carriage motor 44. In the embodiment, ink is discharged from the discharge head 31 only when the carriage 33 moves in the scanning direction X2. In other words, unidirectional printing is performed in the printing device 10 of the embodiment.

As shown in FIGS. 1 and 2, the support unit 50 includes a mounting table 51 on which the medium M is mounted and a frame body 52 attached to the mounting table 51. The mounting table 51 and the frame body 52 have a substantially rectangular shape in plan view. The frame body 52 presses the medium M to the mounting table 51 in a state in which the frame body 52 is attached to the mounting table 51, so that the frame body 51 suppresses posture change of the medium M. In the description below, a state in which the medium M is held between the mounting table 51 and the frame body 52 of the support unit 50 is referred to as a state in which the medium M is supported by the support unit 50.

As shown in FIG. 1, the transport unit 60 includes a drive pulley 61 that is provided at the other end side (Y2 side) in the transport direction Y, a driven pulley 62 that is provided at one end side (Y1 side) in the transport direction Y, a timing belt 63 that is wrapped around the drive pulley 61 and the driven pulley 62, and a transport motor 64 that drives the drive pulley 61. The drive pulley 61 and the transport motor 64 are provided in the third housing 23, the driven pulley 62 is provided in the second housing 22, and the timing belt 63 is provided in the first housing 21, the second housing 22, and the third housing 23. The timing belt 63 is coupled to the support unit 50.

In the transport unit 60, when the transport motor 64 is driven, the drive pulley 61 rotates. When the drive pulley 61 rotates, the timing belt 63 that is wrapped around the drive pulley 61 and the driven pulley 62 rotates. Subsequently, the support unit 50 coupled to the timing belt 63 moves and the medium M is moved (transported) along with the support unit 50 in the transport direction Y. The support unit 50 moves in the transport direction Y1 or in the transport direction Y2 according to a rotation direction of the transport motor 64.

As shown in FIG. 2, the maintenance unit 70 includes a cap 71 that is arranged at a maintenance position at one end side (X1 side) in the scanning direction X and a waste liquid receiving portion 72 that is arranged at a maintenance position at the other end side (X2 side) in the scanning direction X. The cap 71 performs capping that makes a space, to which the nozzles 32 of the discharge head 31 open, a closed space. The capping suppresses drying of the nozzles 32 of the discharge head 31 when a state continues in which no ink is discharged from the discharge head 31 (for example, when the power of the printing device 10 is turned off).

On the other hand, the waste liquid receiving portion 72 receives waste liquid discharged from the discharge head 31 when flashing is performed in which ink is discharged from the discharge head 31 to a place other than the medium M. The flashing is performed to suppress occurrence of discharge failure of the nozzles 32, which, for example, have not discharged ink for a certain period of time, among the plurality of nozzles 32 formed in the discharge head 31.

Next, a control unit 100 of the embodiment will be described. As shown in FIG. 2, the printing device 10 includes the control unit 100 that controls various components. The control unit 100 is connected with a terminal 200 such as a personal computer, a server, and a smartphone via an interface not shown in the drawings. The control unit 100 receives image data to be printed from the terminal 200 along with a print instruction. In the embodiment, the image data to be printed includes a background and an image that are arranged to be adjacent to each other.

The control unit 100 generates print data based on the image data transmitted from the terminal 200. Specifically, the control unit 100 generates print image data where each pixel is represented by a small number of gradations (for example, four gradations) by performing resolution conversion processing, color conversion processing, halftone processing, rasterizing processing, and the like on the received image data. Subsequently, the control unit 100 generates print data by adding control data for controlling each component of the printing device 10 to the print image data.

Then, the control unit 100 causes a transport operation to be performed that moves the support unit 50 by a unit transport amount in the transport direction Y so as to cause printing to be performed based on the generated print data. Further, the control unit 100 causes a printing operation to be performed that causes the discharge head 31 (the nozzles 32) to discharge ink to the medium M supported by the support unit 50 while causing a relative movement operation to be performed that causes the carriage 33 to relatively move with respect to the medium M in the scanning direction X.

The printing operation includes a base printing operation that prints a base (hereinafter also referred to as "base P1") by discharging base ink to the medium M and a background printing operation that prints a background (hereinafter also referred to as "background P2") by discharging background ink to the medium M. The printing operation further includes an image printing operation that prints an image (hereinafter also referred to as "image P3") by discharging image ink to the medium M. The printing operation is an operation including the relative movement operation.

Here, in the embodiment, the background ink is white ink, the image ink is cyan ink, magenta ink, yellow ink, and black ink, and the base ink is white ink having the same color as that of the background ink. In this respect, in the embodiment, the nozzles 32 that discharge white ink correspond to an example of "first nozzles" that discharge the background ink to the medium M to print the background P2, and the nozzles 32 that discharge cyan ink, magenta ink, yellow ink, and black ink correspond to an example of "second nozzles" that discharge the image ink to the medium M to print the image P3.

Further, in the embodiment, the control unit 100 causes layer printing to be performed in which the base P1 is printed on the medium M and then the background P2 and the image P3 are overprinted on the base P1. Next, a processing routine, which is performed by the control unit 100 to cause the layer printing to be performed, will be described with reference to a flowchart shown in FIG. 4.

Figure 4:
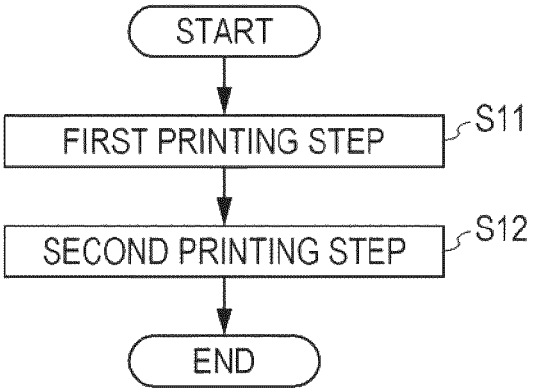
FIG. 4 is a flowchart showing a processing routine executed by a control unit to cause layer printing to be performed.

As shown in FIG. 4, the control unit 100 performs a first printing step that causes the base P1 to be printed on the medium M (step S11). Specifically, in the first printing step, the base is printed by alternately performing the transport operation and the base printing operation. In this respect, in the embodiment, the first printing step corresponds to an example of a "base printing step".

It is preferable that the size of the base P1 printed on the medium M is greater than or equal to the size of the background P2 and the image P3 in the image data. In the embodiment, the size of the base P1 is equal to the size of the sum of the background P2 and the image P3 in the image data.

Subsequently, the control unit 100 performs a second printing step that causes the background P2 and the image P3 to be printed on the medium M (step S12). Specifically, in the second printing step, the background P2 and the image P3 are printed by alternately performing the transport operation and the operations of background printing and image printing. In this respect, in the embodiment, the second printing step corresponds to an example of a "background printing step" and an "image printing step". Thereafter, the control unit 100 ends the processing routine.

As described above, in the embodiment, the first printing step (the base printing step) is performed before the second printing step (the background printing step and the image printing step). In the second printing step, the background printing step and the image printing step are performed in parallel. In other words, the background printing step and the image printing step are performed in one relative movement operation, and the background and the image are printed at the same time.

In the embodiment, printing is performed on the medium M only when the medium M (a support table) is transported in the transport direction Y2. Specifically, the medium M (the support table) that has moved in the transport direction Y2 by performing the base printing step in step S11 is moved in the transport direction Y1 before starting the background printing step and the image printing step.

Figure 5:
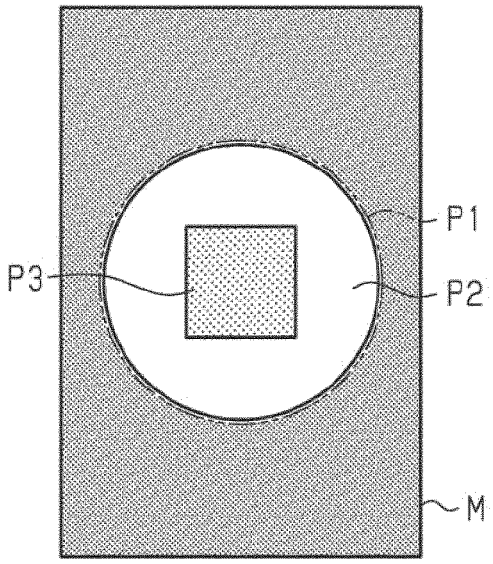
FIG. 5 is a schematic diagram showing a medium on which a background and an image are printed.

Next, a comparative example of a method of printing a circular background P2 and a square image P3 adjacent to each other on a deep color medium M as shown in FIG. 5 will be described with reference to FIGS. 6 and 7. FIG. 5 shows a state in which the layer printing is performed on the medium M. The background P2 and the image P3 are overprinted on the base P1.

Figure 6:
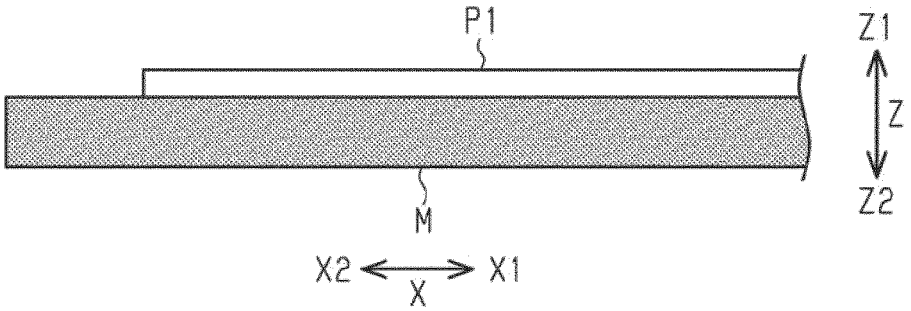
FIG. 6 is a cross-sectional view showing a medium on which a base is printed.
Figure 7:
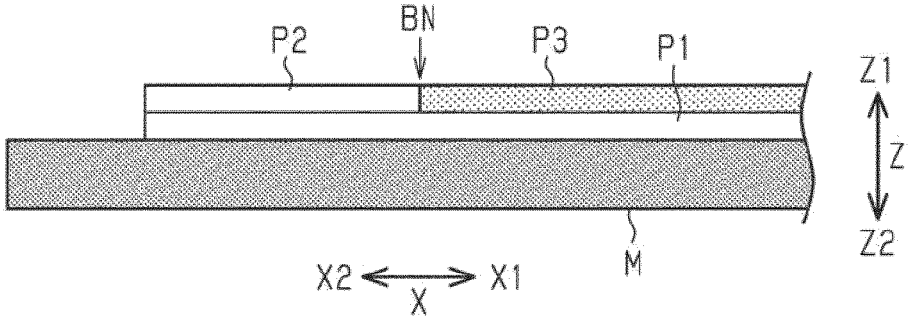
FIG. 7 is a cross-sectional view of a medium on which a background and an image are printed in a comparative example.

In the printing method of the comparative example, when the layer printing is performed on the medium M as shown in FIG. 5, the base printing step (the first printing step) is performed, so that the base P1 is printed on the medium M as shown in FIG. 6. Then, as shown in FIG. 7, after the base P1 that is printed on the medium M by performing the base printing step dries, the background printing step and the image printing step (the second printing step) are performed in parallel (at the same time), so that the background P2 and the image P3 are printed overlapping the base P1.

Here, the background printing step and the image printing step are performed in parallel, so that when one of the background ink and the image ink lands on the medium M and thereafter the other ink lands on an area close to an area where the one ink lands before the one ink dries, there is a risk that colors of the one ink and the other ink are mixed. Further, when the background ink and the image ink land on areas close to each other at the same time, there is a risk that colors of the background ink and the image ink are mixed in the areas. Therefore, in a boundary BN between the background P2 and the image P3 that are printed on the medium M, there is a risk that colors of the background ink and the image ink that are discharged to the medium M are mixed and blur occurs.

Therefore, in the embodiment, when the background P2 and the image P3 are printed adjacent to each other on the medium M, a "non-printing area NPA" where no ink is discharged is provided so that the background ink and the image ink are not discharged to a portion to be the boundary BN between the background P2 and the image P3. In other words, in the embodiment, when the boundary BN between the background P2 and the image P3 is printed during one (the same) relative movement operation, the control unit 100 provides the non-printing area NPA where the background ink and the image ink are not discharged to the boundary BN between the background P2 and the image P3.

Figure 8:
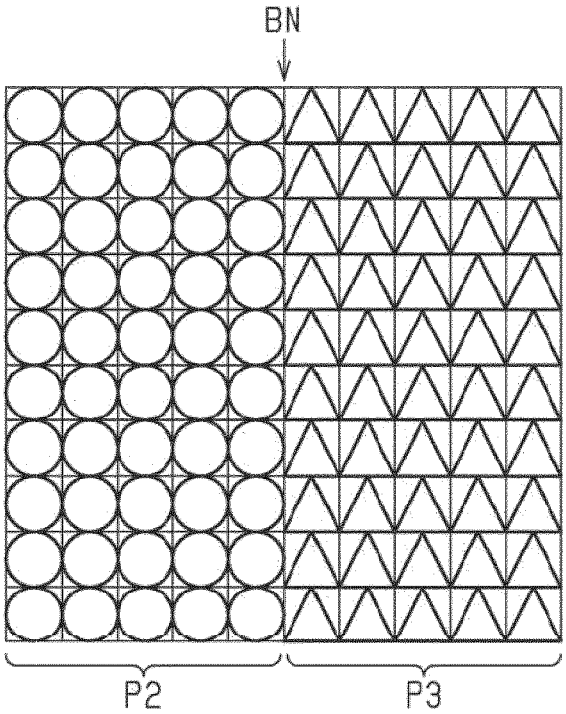
FIG. 8 is a schematic diagram showing image data of a portion where a background and an image are adjacent to each other.
Figure 9:
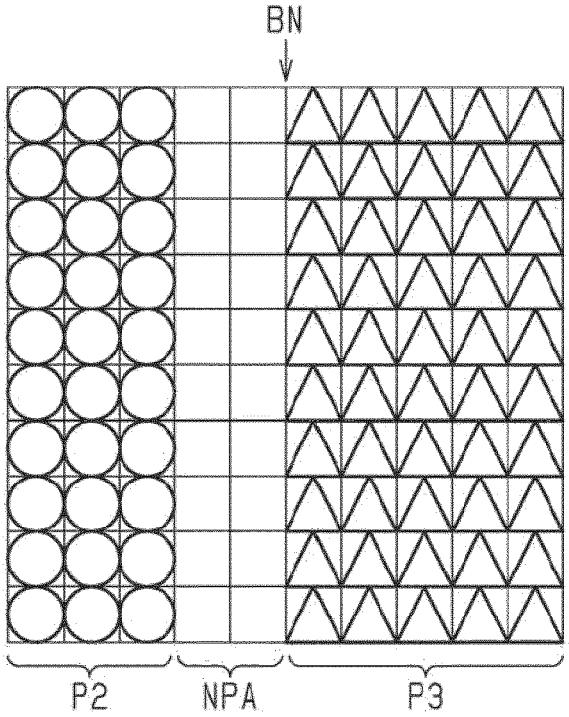
FIG. 9 is a schematic diagram showing image data in which a non-printing area is provided.

Next, a setting method of the non-printing area NPA will be described with reference to FIGS. 8 and 9. FIGS. 8 and 9 are schematic diagrams showing an example of image data of an enlarged area near the boundary BN between the background P2 and the image P3. In FIGS. 8 and 9, the grid shown by solid lines represents pixels, the signs "○" shown in the grid represent pixels included in the background P2, and the signs "Δ" shown in the grid represent pixels included in the image P3. Specifically, a pixel where the sign "○" is shown is a pixel of a color (white) of the background P2, and a pixel where the sign "Δ" is shown is a pixel of a color (for example, yellow) of the image P3.

As shown in FIGS. 8 and 9, pixels included in the background P2 adjacent to the boundary BN between the background P2 and the image P3 among the pixels included in the image data are defined as pixels that are not included in either the background P2 or the image P3. For example, the pixels included in the background P2 adjacent to the boundary BN between the background P2 and the image P3 are transparent pixels. By doing so, neither the background ink nor the image ink is discharged to a portion corresponding to the transparent pixels of the image data. A range of the non-printing area NPA may be appropriately determined by the control unit 100 or may be specified when a user of the printing device 10 issues a print instruction to the printing device 10.

Incidentally, it can be considered to suppress the generation of blur by promoting drying of the background P2 or the image P3, which is printed earlier, by not performing the background printing step and the image printing step in parallel, in other words, by performing at least one of the background printing step and the image printing step and thereafter performing the other step. However, in this case, the printing speed decreases because the background printing step and the image printing step have to be performed separately.

Figure 10:
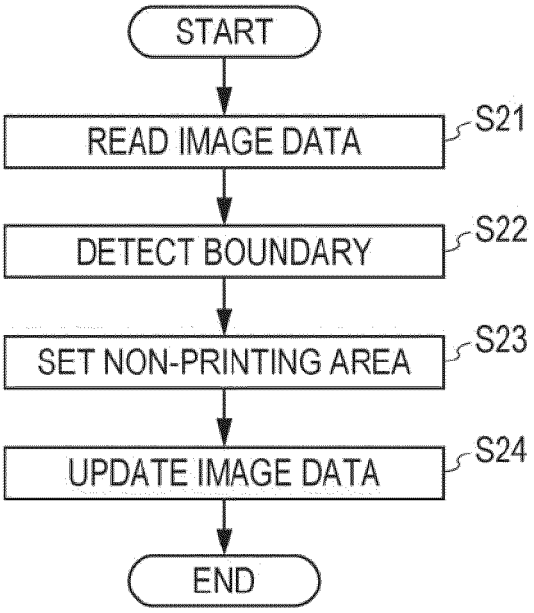
FIG. 10 is a flowchart showing a processing routine executed by the control unit to set a non-printing area.

Next, a processing routine, which is performed by the control unit 100 to provide the non-printing area NPA in the image data, will be described with reference to a flowchart shown in FIG. 10. As shown in FIG. 10, in the processing routine, the control unit 100 reads image data (step S21) and extracts the boundary BN between the background P2 and the image P3 based on color information of pixels included in the image data (step S22). Here, when issuing a print instruction, the user of the printing device 10 may specify a background color in advance and/or may specify a position of the boundary BN in order to easily extract the boundary BN between the background P2 and the image P3.

Subsequently, the control unit 100 sets the non-printing area NPA in the image data by making transparent the pixels included in the background P2 adjacent to the boundary BN between the background P2 and the image P3 among the pixels included in the read image data (step S23). Thereafter, the control unit 100 updates the image data read in step S21 to the image data in which the non-printing area NPA is set (step S24) and ends the processing routine.

In steps S23 and S24, if original image data is RGB color model, subsequent image data may be RGBA color model in which color transparency information is added.

Next, effects of the printing device 10 and the printing method of the embodiment will be described. In the embodiment, when the background P2 and the image P3 based on the image data are printed adjacent to each other on a deep color medium M, the non-printing area NPA is set in the image data. Specifically, as shown in FIG. 9, among the pixels adjacent to the boundary BN between the background P2 and the image P3 in the image data, pixels included in the background P2 are made transparent. Then, print data is generated based on the image data in which the non-printing area NPA is provided, and printing is performed on the medium M based on the print data.

Figure 11:
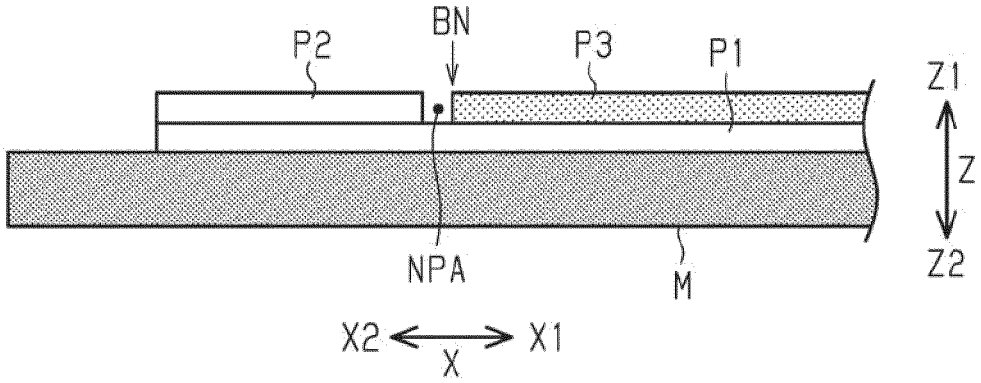
FIG. 11 is a cross-sectional view of a medium on which a background and an image are printed in the embodiment.

As shown in FIG. 6, in the embodiment, the base printing step is performed, so that the base P1 is printed on the medium M. Subsequently, as shown in FIG. 11, the background printing step and the image printing step are performed in parallel (at the same time), so that the background P2 and the image P3 are overprinted on the printed base P1. Here, the background printing step and the image printing step are performed after the base printing step is completed, so that it is suppressed that the printing of the background P2 and the image P3 is performed on the base P1 that has not been dried.

In the embodiment, the background printing step and the image printing step are performed in parallel. However, the non-printing area NPA is provided in the image data, so that the background ink is not discharged to an area where the background P2 would have been printed (an area adjacent to the boundary BN) in the background printing step and the image printing step that are performed in parallel.

In this way, as shown in FIG. 11, the background P2 is printed away from the boundary BN, so that an area where the background P2 would have been printed becomes the non-printing area NPA where neither the background P2 nor the image P3 is printed. Thereby, even when the background printing step and the image printing step are performed in parallel, it is suppressed that the colors of the background ink and the image ink are mixed and blur occurs at the boundary BN where the background P2 and the image P3 are printed.

In the embodiment, both the background ink and the base ink are white ink, so that colors of both the area where the background P2 is printed and the non-printing area NPA are white in plan view in FIG. 11. Therefore, even when the non-printing area NPA is provided and thereby the base P1 is exposed, the base P1 is assimilated into the background P2, so that variation in appearance is suppressed.

According to the embodiment described above, it is possible to obtain effects described below.

(1) The background printing step in which the background P2 is printed and the image printing step in which the image P3 is printed are performed in parallel, so that it is possible to shorten the time required to print the background P2 and the image P3. Further, the non-printing area NPA where neither the background ink nor the image ink is discharged is provided to the boundary BN between the background P2 and the image P3, so that it is possible to suppress that the colors of the background ink and the image ink are mixed at the boundary BN between the background P2 and the image P3 and blur occurs between the background P2 and the image P3.

In this way, when the background P2 of the background ink and the image P3 of the image ink are printed adjacent to each other, it is possible to shorten the time required to print the background P2 and the image P3 while suppressing occurrence of blur at the boundary BN between the background P2 and the image P3.

(2) The background P2 and the image P3 are printed on the base P1, so that it is possible to obtain good color development of the background P2 and the image P3 regardless of the ground color of the medium M.

(3) When the background P2 and the image P3 are overprinted on the base P1, if the non-printing area NPA is provided, there is a case in which the base P1 is exposed to the boundary BN between the background P2 and the image P3 and thereby the print quality is deteriorated. In this respect, according to the embodiment, the background ink and the base ink are the same color ink, so that even when the base P1 is exposed to the boundary BN between the background P2 and the image P3, the exposed base P1 is seen as integrated with the background P2. Therefore, it is possible to suppress deterioration of print quality.

The above embodiment can be changed as described below. The base ink need not be white ink as long as the base ink has light shielding property. For example, the base ink may be a metallic ink.

The image ink need not be the same as the ink in the embodiment described above as long as the image ink is an ink for forming the image P3. The number of types of the image ink may be smaller than four or may be greater than or equal to five.

The background ink and the base ink may have colors different from each other. The printing device 10 may perform normal printing that prints the background P2 and the image P3 on the medium M without printing the base P1 on the medium M (without performing the base printing step) in addition to the layer printing. In this case, it is preferable that the medium M has a light color in order to obtain good color development of the background P2 and the image P3.

In the embodiment described above, the non-printing area NPA is provided to a background area adjacent to the boundary BN between the background P2 and the image P3 by making transparent the pixels included in the background P2 adjacent to the boundary BN between the background P2 and the image P3 among the pixels included in the background P2 and the image P3 in the image data. However, the non-printing area NPA may be provided in a different manner.

Specifically, the non-printing area NPA may be provided to an image area adjacent to the boundary BN between the background P2 and the image P3 by making transparent the pixels included in the image P3 adjacent to the boundary BN between the background P2 and the image P3 among the pixels included in the background P2 and the image P3 in the image data. Further, the non-printing area NPA may be provided to both the background area and the image area adjacent to the boundary BN between the background P2 and the image P3 by making transparent the pixels included in the background P2 and the image P3 adjacent to the boundary BN between the background P2 and the image P3 among the pixels included in the background P2 and the image P3 in the image data.

In the printing device 10, the non-printing area NPA is provided in image data by editing the image data. However, the non-printing area NPA may be provided in print data by editing the print data.

In the embodiment described above, the control unit 100 of the printing device 10 edits image data and generates print data based on the image data. However, these processing may be performed by the terminal 200 connected to the printing device 10. Specifically, the above processing may be performed by a printer driver of the terminal 200 connected to the printing device 10.

When providing the non-printing area NPA, it is not necessary to make specific pixels in the image data transparent. For example, a print flag is provided for each pixel of image data, and the print flags of pixels where no printing is performed are turned off. On the other hand, the print flags of pixels where printing is performed are turned on. When generating print data from the image data, it is possible to generate the print data, in which the non-printing area NPA is provided, by referring to information of the print flags.

When the size of the non-printing area NPA is constant, if the discharge amount of the background ink and the image ink increases at the boundary BN between the background P2 and the image P3, the inks discharged to an area adjacent to the non-printing area NPA easily soak into the non-printing area NPA in the medium M to which the inks are discharged, so that the risk of color mixture of both inks increases.

Therefore, in at least one of the background printing step and the image printing step, when the discharge amounts of the background ink and the image ink are large at the boundary BN between the background P2 and the image P3, the size of the non-printing area NPA may be increased as compared with a case where the discharge amounts are small.

Accordingly, when the discharge amounts of the background ink and the image ink are large, the size of the non-printing area NPA is increased as compared with a case where the discharge amounts are small. Therefore, it is possible to suppress occurrence of the above situation. In other words, it is possible to suppress deterioration of print quality by adjusting the size of the non-printing area NPA according to the discharge amounts of the background ink and the image ink.

When the medium M to be printed is a medium M that does not easily absorb ink in at least one of the background printing step and the image printing step, the size of the non-printing area NPA may be increased as compared with a case where the medium M to be printed is a medium M that easily absorbs ink.

In the embodiment described above, a unit transport amount in the transport operation may be smaller than the length of the nozzle array 35 in the transport direction Y and may be appropriately changed according to whether the print quality or the print speed is prioritized.

Specifically, when the print quality is desired to be prioritized, it is desirable that the unit transport amount is one-eighth or one-sixteenth of the length of the nozzle array 35 in the transport direction Y, and when the print speed is desired to be prioritized, it is desirable that the unit transport amount is a half or a quarter of the length of the nozzle array 35 in the transport direction Y.

When performing printing on a transparent film used as an example of the medium M so that a print result is seen from the side opposite to the printed surface, the base printing step may be performed after the background printing step and the image printing step are performed on the film. In this case, the background P2 and the image P3 are printed in a first layer and the base P1 is printed in a second layer.

Printing may be performed when the carriage 33 moves in the scanning direction X1. Further, printing may be performed when the carriage 33 moves in both the scanning direction X1 and the scanning direction X2. In other words, the printing device 10 may perform bidirectional printing.

The medium M may be a medium M such as, for example, paper, fiber, leather, plastic, wood, and ceramic. Further, the medium M may be a long medium M drawn out from a roll body or may be a single sheet paper.

When the printing device 10 is a printing device that performs printing on a paper, which is an example of the medium M, the transport unit 60 may be a transport unit that includes a transport roller and a drive roller vertically below and vertically above a transport path of the medium M and transports the medium M by rotating these rollers.

The printing unit 30 may be a line head whose length in the scanning direction is longer than lengths in the scanning direction of all the media M that can be a print object and which is fixedly arranged so as not to move in the scanning direction X. In this case, the medium M (the support unit 50) moves in the transport direction Y (Y1) with respect to the fixedly arranged line head, so that the "relative movement operation" is performed in which the medium M and the line head (the first nozzles and the second nozzles) move relatively. That is, in this case, the transport unit 60 in the embodiment described above corresponds to an example of "moving unit".

The "one relative movement operation" in this case is an operation to discharge ink to the entire area in the scanning direction X of the medium M that is transported in the transport direction Y (Y1) and is an operation in which the support unit 50 is transported from one end in the transport direction Y to the other end from when printing of one medium M is started to when the printing of the one medium M is completed.

This application claims priority under 35 U.S.C. § 119 to Japanese Patent Application No. 2016-074976, filed Apr. 4, 2016. The entire disclosure of Japanese Patent Application No. 2016-074976 is hereby incorporated herein by reference.

What is claimed is:

1. A printing method of printing a background and an image on a medium, the printing method comprising:

a background printing step of printing a background on the medium by discharging background ink;

an image printing step of being performed in parallel with the background printing step and printing an image on the medium by discharging image ink, wherein a non-printing area, where the background ink and the image ink are not discharged to a boundary between the background and the image, is provided in the background printing step and the image printing step; and a base printing step of printing a base by discharging base ink to the medium before the background printing step and the image printing step, wherein the background and the image are overprinted on the base, wherein the background ink and the base ink are ink of the same color.

2. A printing device that prints a background and an image on a medium, the printing device comprising:

a first nozzle that discharges background ink to the medium to print the background;

a second nozzle that discharges image ink to the medium to print the image;

a moving unit that performs a relative movement operation that relatively moves the medium and the first and the second nozzles; and a controller configured to cause the first nozzle to discharge the background ink to print the background and to cause the second nozzle to discharge the image ink to print the image during the relative movement operation, wherein the controller provides a non-printing area, where the background ink and the image ink are not discharged to a boundary between the background and the image, when causing the boundary between the background and the image to be printed during one relative movement operation, wherein the controller is configured to cause a base to be printed on the medium with base ink that is the same color as the background ink before the background ink and the image ink are discharged to the medium, wherein the background and the image are overprinted on the base.

* * * * *